US008601784B2

(12) United States Patent
Kaltenrieder

(10) Patent No.: US 8,601,784 B2
(45) Date of Patent: Dec. 10, 2013

(54) ANTI-ROTATION LINK

(71) Applicant: The Swatch Group Management Services AG, Biel (CH)

(72) Inventor: Cédric Kaltenrieder, Bienne (CH)

(73) Assignee: The Swatch Group Management Services AG, Bienne (CH)

( * ) Notice: Subject to any disclaimer, the term of this patent is extended or adjusted under 35 U.S.C. 154(b) by 0 days.

(21) Appl. No.: 13/709,653

(22) Filed: Dec. 10, 2012

(65) Prior Publication Data

US 2013/0152542 A1 Jun. 20, 2013

(30) Foreign Application Priority Data

Dec. 16, 2011 (EP) ..... 11194104

(51) Int. Cl.
*A44C 5/02* (2006.01)
*A44C 5/10* (2006.01)
*A44C 5/24* (2006.01)

(52) U.S. Cl.
USPC ..... 59/78; 59/80; 59/87; 63/3; 63/9; 63/38; 24/265 B; 24/265 WS

(58) Field of Classification Search
USPC ..... 59/78, 80, 87; 64/3, 3.1, 9, 38; 24/265 B, 265 WS
See application file for complete search history.

(56) References Cited

U.S. PATENT DOCUMENTS 3,965,670 A * 6/1976 Ihringer ..... 59/79.1
6,101,842 A * 8/2000 Delacretaz ..... 59/80

FOREIGN PATENT DOCUMENTS

| | | | |
|---|---|---|---|
| CH | 664 475 | A5 | 3/1988 |
| CH | 689 534 | A5 | 6/1999 |
| CN | 2473952 | Y | 1/2002 |
| DE | 815 860 | | 10/1951 |
| EP | 0 081 616 | A1 | 6/1983 |
| FR | 1.178.663 | | 5/1959 |
| FR | 2 425 820 | | 12/1979 |
| JP | 2004-73346 | | 3/2004 |

OTHER PUBLICATIONS

European Search Report issued Apr. 24, 2012 in corresponding European Application No. 11194104 filed on Dec. 16, 2011 (with an English Translation).

* cited by examiner

*Primary Examiner* — David B Jones
(74) *Attorney, Agent, or Firm* — Oblon, Spivak, McClelland, Maier & Neustadt, L.L.P.

(57) ABSTRACT

Link for a wristwatch, characterized in that it comprises a central core connecting a lower wing and an upper wing.

9 Claims, 4 Drawing Sheets

ANTI-ROTATION LINK

This application claims priority from European Patent Application No. 11194104.3 filed Dec. 16, 2011, the entire disclosure of which is incorporated herein by reference.

FIELD OF THE INVENTION

The present invention relates to a special link for a wristwatch. The present invention also relates to a system for attaching a watch band strand to a closure comprising such a link.

BACKGROUND OF THE INVENTION

So-called deployment clasp closures are known in the prior art that allow the watch to be threaded on easily when the clasp is folded out and to then tighten the wrist band in closed position. This type of closure generally comprises a metal cover that closes over the folding tabs, one end of which is attached to the end of one of the strand of the watch band, while the end of the other strand is fixed to an end of the cover. The fastener can be locked by means of a pushbutton mechanism acting in a transverse direction.

Such closures are often used in combination with watch bands that have strands formed by rows of articulated metal links. In this case the adjustment of the length of the watch band is achieved by removing one or more links at the end of one or more strands before attaching these ends to the closure.

In the case of rubber watch bands the length is generally adjusted simply by cutting off a desired length of the band at the attachment end of the strand before then joining this end of the strand to the closure again or to a connection piece of the closure. However, this simple solution requires adapting the closure or at least an attachment piece of the closure to the strand to conceal the visible cut edge of the strand and also prevent rotation of the end of this strand in relation to the closure in order to prevent the cut edge of the strand from protruding onto the skin of the user and rendering use of such a watch band particularly uncomfortable. Therefore, in the case of a plastic watch band the abovementioned length adjustment by simple cutting cannot be made without modifying the structure of the closure, which prevents the use of the same closures for bands made of plastic or leather and even metal or ceramic, and therefore causes substantial losses in productivity.

Closure systems adapted to any type of watch band, i.e. made of leather, fabric, plastic or metal, are additionally known such as the closure described in document EP 0081616, for example. In this type of closure the ends of the strands 9, 13 of the watch band can be fixed by means of connector bars 10, 14 in different pairs of holes 7, 11 of circular arc-shaped tubular pieces 1, 2 engaging into one another to define a nominal length for the band, while locking assured by cooperation of a rack 6 and an elastic element 23 allows a quick and easy fine adjustment thereof. However, this type of closure has a complex structure that is difficult to machine and poses reliability problems with respect to the locking system compared to classic deployment clasp closures.

Special devices for attaching a watch band strand to a deployment clasp closure are also known, such as the system described in the Swiss patent CH 689534, for example, according to which studs 13, 14 are respectively arranged in front of a loop 19 of the closure and on one of the tabs of the deployment clasp to cooperate with perforations 21-26 of a strand 6 of the watch band. However, this type of device is only suitable for watch bands with perforated strands and modifies the structure of the deployment clasps of the closure, which restricts the possible uses thereof considerably.

Therefore, there is a need for watch bands without the known limitations of the prior art in terms of structural shortcomings and/or locking reliability.

SUMMARY OF THE INVENTION

An aim of the present invention in particular is to provide a solution that allows simple adjustment of the length of any type of watch band, in particular rubber watch bands, without requiring significant structural changes with respect to the closure or to the attachment system to the closure.

These aims are achieved by means of a link for a watch band such as claimed in the main claim, characterised in that it comprises a central core connecting a lower wing and an upper wing.

These aims are also achieved by means of a device for fastening a closure to a watch band strand comprising an attachment piece and such a link arranged between the attachment piece and the end of the strand, characterised in that a first inside surface of the upper wing, a first inside surface of the lower wing and a first side wall of the core of the link form a first receptacle for an end of the strand, that a second inside surface of the upper wing, a second inside surface of the lower wing and a second side wall of the core of the link form a second receptacle for a central part of the attachment piece, wherein the upper core of the link covers the end of the strand and the central part of the attachment piece.

An advantage provided by the link according to the invention relates to the improvement of the overall aesthetic appearance of the watch and of the wearing comfort for the user of the watch.

Another advantage of the proposed solution is to provide an inexpensive simple piece that is easily machined and can be adapted to different types of watch bands and closures.

An additional advantage of the proposed solution is to introduce a very simple intermediate piece between the end of the strand of the watch band and an attachment piece of a closure instead of acting on one or other of these pieces to provide advantages in terms of comfort and aesthetic appearance. The fact that no change is required either with respect to the strand or the closure substantially improves the modularity of the proposed solution and provides significant benefits in terms of productivity for the simultaneous production of watches provided with different types of watch bands.

BRIEF DESCRIPTION OF THE DRAWINGS

Other characteristics and advantages will become clearer from the detailed description of various preferred embodiments and the attached drawings, wherein.

DETAILED DESCRIPTION OF THE PREFERRED EMBODIMENTS

Figure 1:
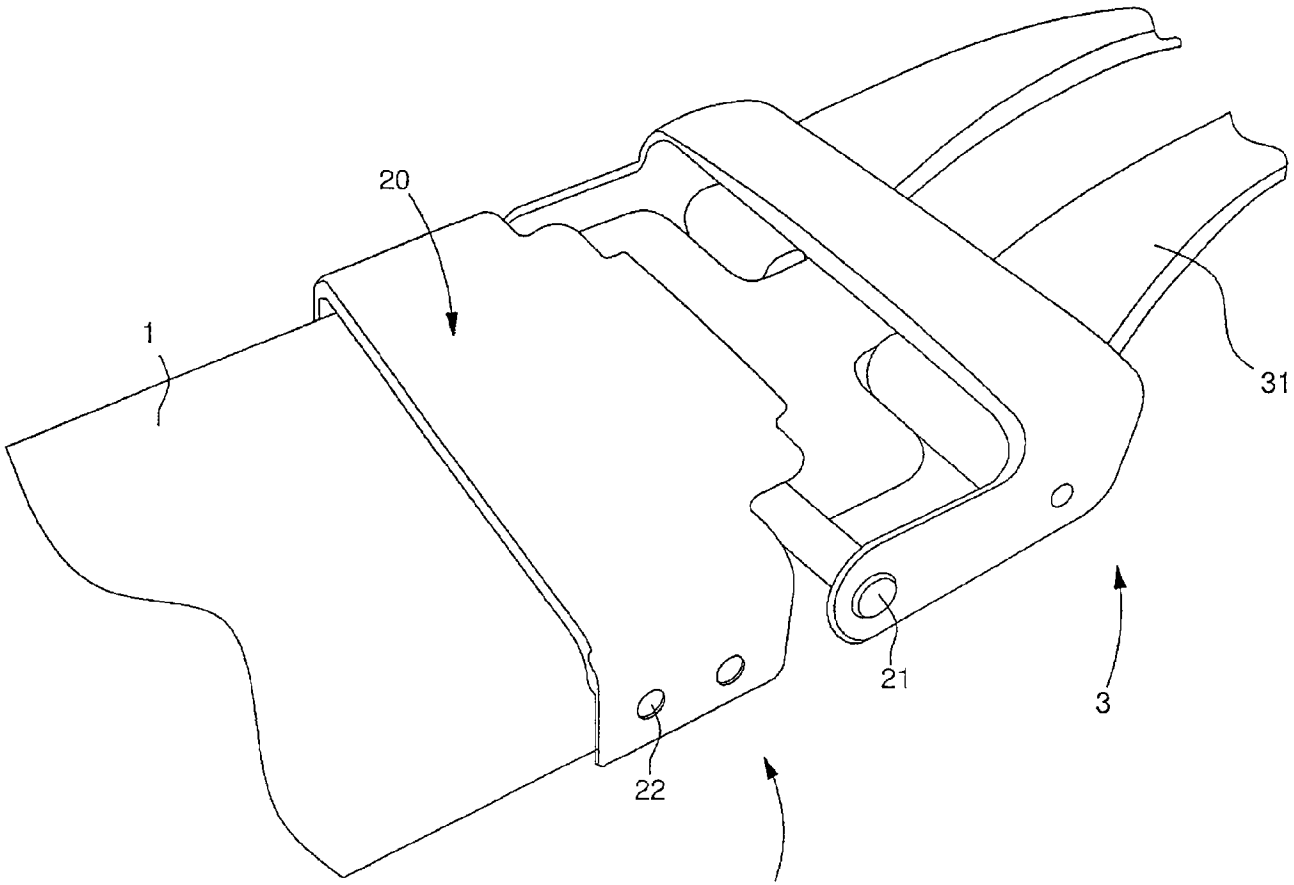
FIG. 1 is a plan view onto a modified closure attachment link known from the prior art.

FIG. 1 illustrates an example of the modified attachment piece 2 known from the prior art for a deployment clasp closure and intended for use with a rubber watch band. The shown closure 3 classically comprises two folding tabs that only occupy a single thickness in folded position, in this case a shaft 31 formed from two arms, between which a central tab (not shown because the closure is shown in deployed position) comes to rest. The shaft 31 is mounted to be movable around a connecting pin to a piece of the closure, which is itself articulated to an attachment piece of the strand 2. The rotation axis between the closure 3 and the attachment piece of the strand 2 is embodied by reference 21 in this figure. The end of a strand 1 of the watch band is connected to the attachment piece 2 by means of a connector bar 22. In order to conceal the cut edge of the end of the strand 1, a screening surface 20 is arranged on an upper face of the attachment piece 2. Moreover, to prevent any contact of the cut edge of the end of the strand with the skin of the user, another screening surface (not visible in this figure) is similarly arranged on the lower face of the attachment piece. These two screening surfaces prevent the end of the strand from rotating around the connector bar 22 and thus increase the wearing comfort for the user of the watch provided with a watch band and such an attachment piece, while also improving the aesthetic appearance of the watch band by concealing the cut section of the end of the watch band that is not necessarily neat.

Nevertheless, this modified attachment piece 2 requires a dedicated production method: thus, it can be formed, for example, from a uniform metal plate that is stamped, then folded to respectively form the upper screening surface 20 and the side faces, in which holes are then machined to receive the ends of the connector bar 22, while a plate forming a bottom cover is fixed by welding, for example, to form the lower screening surface. It is also possible to cut out and then fold the attachment piece in one operation and to form the lower part so that the underside of the strand can be concealed by two folded ends that are welded at their junction point. In both cases the stamping requires complex equipment that incurs very high production costs. In addition, the welding operation that increases the total and unit cost slows down the production process. It is also conceivable to machine the attachment piece including the upper and lower screening surfaces as well as the side faces directly in a solid piece, but such a production method would be even more costly because of the material losses caused. Whatever the selected machining method, such attachment pieces could no longer be used for other types of watch band, e.g. leather or even ceramic or metal watch bands, for which a traditional open attachment piece, i.e. without upper and lower screening surfaces, is required to prevent any blocking of the last links or of the winding of the leather at the attachment axis, i.e. the connector bar 22 in the illustrated example.

In the following the link is described to show that the same advantages in terms of comfort and aesthetics as the known prior art solution known of FIG. 1 can be benefited from without having to modify the structure of a closure or that of a usual attachment piece.

Figure 2:
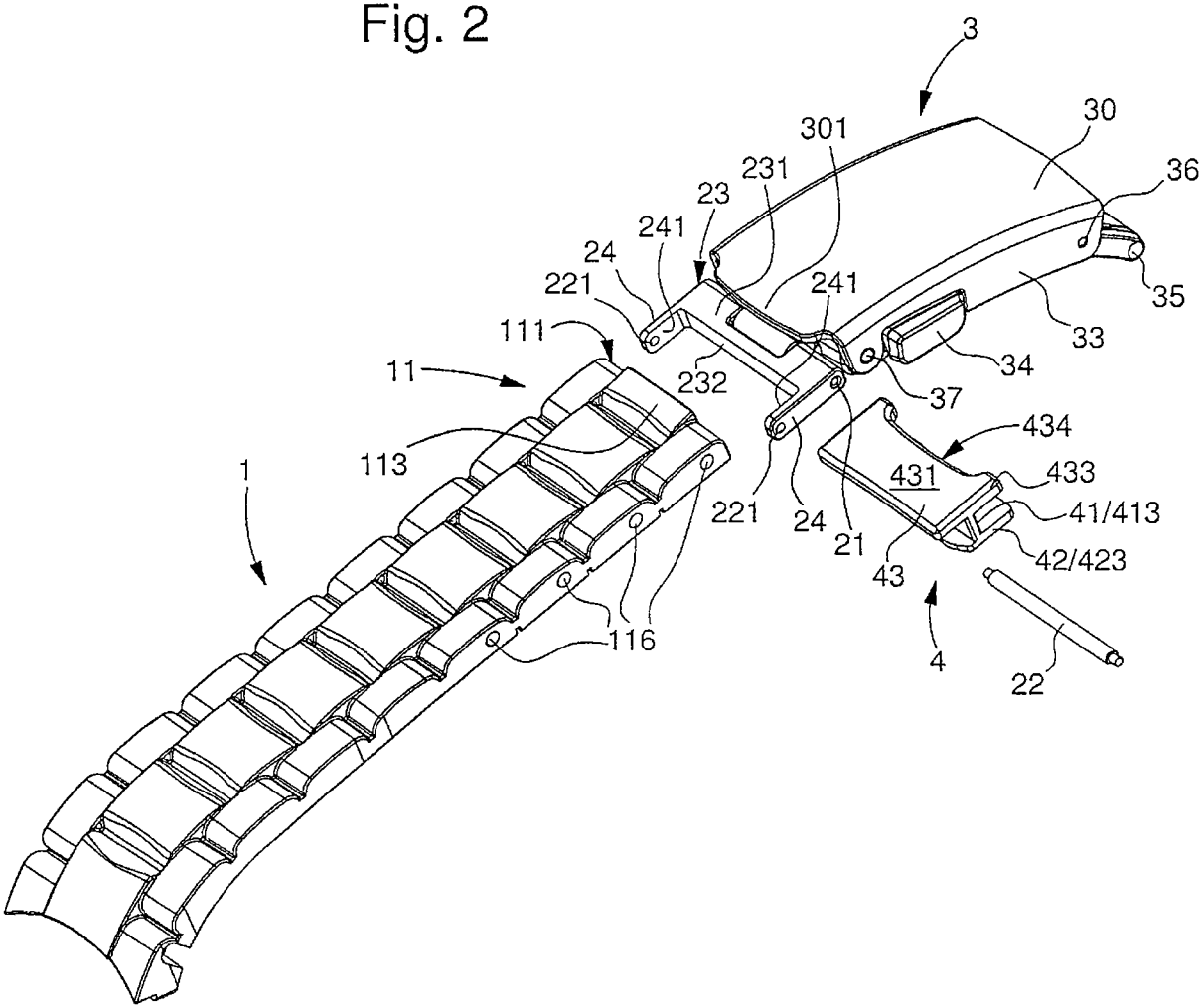
FIG. 2 is a perspective view of an intermediate link according to a preferred embodiment of the invention showing its positioning in relation to the watch band and the closure.

This link according to the invention is preferably interposed between the end of the strand 1 and the attachment piece 2 so that it is no longer necessary to modify this attachment piece 2. FIG. 2 shows an example of a preferred variant of such an intermediate link 4 interposed between the end of the strand 11 of a rubber watch band and the attachment piece 2 to the closure 3. This link comprises a central core 41, which connects a lower wing 42 and an upper wing 43, the functions of which are respectively identical to those of the screening surfaces of the modified attachment piece of FIG. 1: the upper wing 43 conceals the cut edge 111 of the end of the strand, since only the upper surface 431 of this wing is visible to the eye of the user, whereas the lower wing 42 prevents the strand from rotating around the connector bar 22 in the direction endeavouring to bring the cut edge 11 of the end of the strand 1 in contact with the skin of the user. A person skilled in the art would understand the wings to be pieces, in which two dimensions are much larger than the third, as is the case here concerning the ratio between their length, width and thickness. Most of these different parameters that determine the shape of the link 4 according to the invention will be described in more detail on the basis of FIG. 4B.

As is evident from FIG. 2, the intermediate link 4 does not have its own fastening element around an axis, in contrast to a traditional watch band link forming part of an articulated chain, but by virtue of its particular shape with a cross-section in the shape of a truncated H is instead held between the connector bar 22 for fastening the strand 1 of the watch band and a central part 23 of the attachment piece 2, the side 232 and upper 231 surface of which are visible. The link 4 is assembled by inserting the first flanks 413 of the central core 41 between the side faces 24, with the inside surfaces 241 thereof acting as guide surfaces. The link 4 is thus caused to slide along the parallel side faces 24 of the attachment piece 2 up to the side surface 232 of the attachment piece 2, against which the right side wall 412 of the core 41 of the link comes into abutment. To prevent any translation movement of the link in the opposite direction to that in which it is inserted between the side faces 24 of the attachment piece 2, the cut edge 111 of the end of the strand 1 is brought into abutment against the left side wall 411 of the core 41 of the link. The connector bar 22 is then fitted into the last of the through holes 116 arranged in the strand 1 up to the cut edge 111 of the end 11 of the strand 1 of the watch band, the length of which has been determined, for example, by cutting, and the connector bar is then inserted into the pair of holes 221 of the attachment piece 2. This insertion of the connector bar 22 enables the strand 1 of the watch band to be fastened to the attachment piece 2 and therefore indirectly to the closure 3 and at the same time enables the space into which the link 4 has been inserted to be closed. The latter is thus held between the central part 23 of the attachment piece 2 and the end of the strand 11 fixed around the connector bar 22 without requiring any additional fastening element. To facilitate the machining of the link 4, the second flanks 423 of the lower wing 42 and the third flanks 433 of the upper wing 43 have been arranged in the same plane as that of the first flanks 413 of the core of the link 41.

The closure 3 used in the framework of the invention can be a classic deployment clasp closure, as illustrated in FIG. 2, that comprises an elongated cover 30 that conceals the folding tabs articulated around a common connecting pin 35 when in locked position. Pushbuttons 34 are arranged on the side faces 33 of the cover for unlocking and holes 36 are also arranged on the side faces 33 of the closure to insert connector bars therein for fastening to a second watch band strand that is not necessarily adjustable in length. According to the illustrated embodiment of the closure of FIG. 2, the folding tabs respectively consist of a shaft 31 comprising two arms and a central tab 32 that sits inside the two arms of the shaft 31 in the folded position. Other structures with folding tabs, e.g. such as butterfly-type structures, can also be considered without having any consequences either for the attachment piece or the link 4 of the invention. The attachment piece 2 here is connected to the shaft 31 by means of the attachment pin 21 to the closure, whereas the central tab 32, 31 is connected to the cover 30 of the closure 3 by means of a connecting pin 37. According to a variant the central tab 32 and the shaft 31 could also be reversed by connecting the central tab 32 to the attachment pin 21 of the closure and the shaft to the cover 30 by the connecting pin 37.

It can be seen in FIG. 2 that the cover 30 of the closure 3 comprises a protruding part 301 extending to the left, i.e. towards the attachment piece 2. The upper wing 43 of the link 4 comprises a cut-out 434 of corresponding shape so that there is no overlap between the link 4 and the closure 3. The corresponding shape of the cut-out 434 of the upper wing 43 of the link and that of the protruding part is particularly evident in FIG. 3, which shows a plan view onto a watch band strand 1, the intermediate link 4 of the invention, the attachment piece 2 and the closure 3 in assembled and locked position. The link 4, of which only the upper face 431 of the upper wing 43 is visible, moulds perfectly to the shape of the cover 3 in such a way that no gap can form between the attachment piece 2 and the closure 3 whatever their angle of orientation relative to one another around the attachment pin 21. Thus, the space visible between the attachment piece 2 and the closure 3 is always at least partially concealed, which is aesthetically advantageous. Moreover, the cooperation of non-linear shapes of the upper wing of the link 43 and the cover 30 around the attachment pin 21 has the advantage compared to the linear shape of the left part of the upper wing 43 of the link 4, for example, that it is more difficult to grip external elements such as the fabric of clothes worn by the user of the watch, for example, because of the curved joining zone between the gripping surfaces which tends to impart a rotation movement and thus release what has been gripped again. The cut-out 434 also creates asymmetry between the left part and the right part of the upper wing 43, which allows the link to be oriented correctly with a view to assembly and the assembly operations to thus be simplified, above all when these are performed manually.

The link 4 is preferably made from injected or moulded plastic material, which allows it to be produced easily and at low cost because of the simplicity of the tools required and the material used, and also allows its colour to be easily matched to that of the band, if necessary. Moreover, its elastic flexibility properties are advantageous for insertion of the end of the strand 1 into the attachment piece 2, as will be seen below with reference to FIGS. 4A and 4B, and consequently for assembly of the link, which does not need to be fitted with a high force that is difficult to achieve without a tool, such as in the case of metal pieces, for example. According to an alternative embodiment, the plastic material could be replaced by a still more flexible elastomer that allows the wings to grip better onto the end of the strand 1.

Figure 4A:
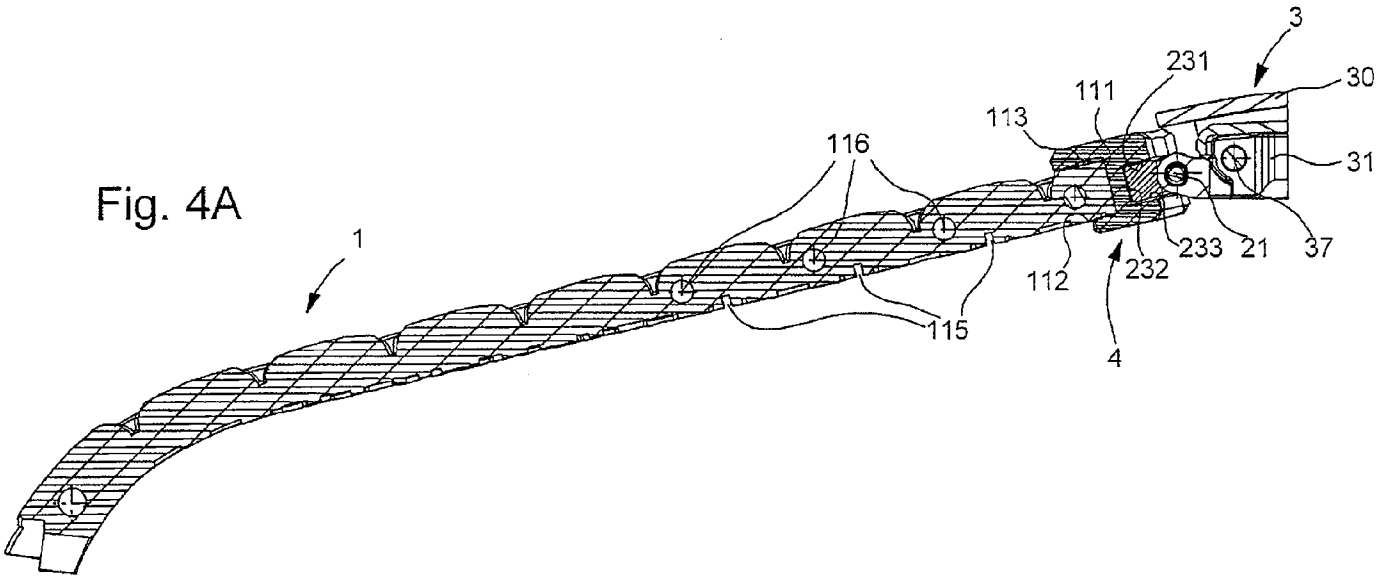
FIG. 4A is a view in sagittal section taken along axis A-A shown in FIG. 3 of the intermediate link according to the same preferred embodiment of the invention.
Figure 3:
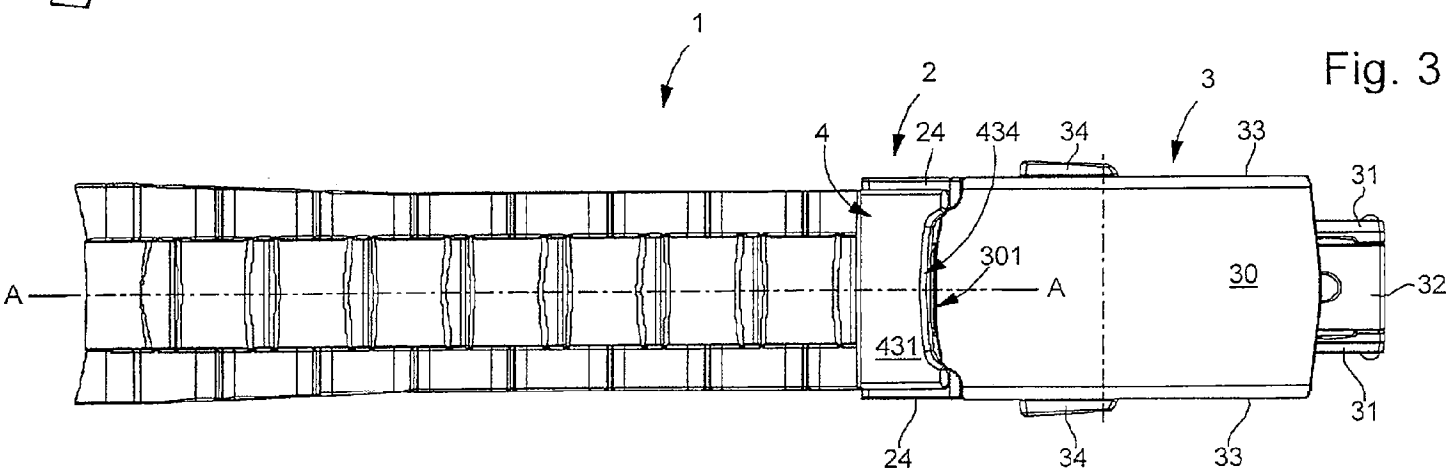
FIG. 3 is a perspective view of an intermediate link according to a preferred embodiment of the invention in assembled position between the strand and the attachment link of the closure.
Figure 4B:
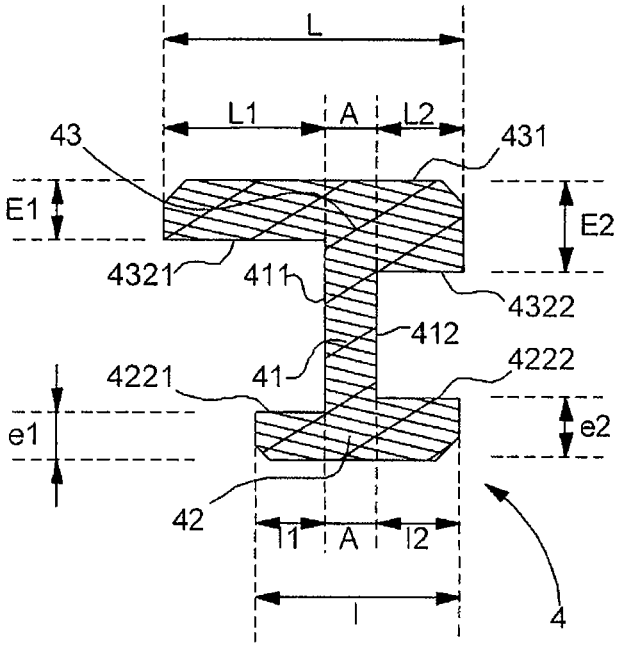
FIG. 4B is an enlarged view in section taken along axis A-A shown in FIG. 3 of the intermediate link of FIG. 4A according to the same preferred embodiment of the invention.

Otherwise evident from FIG. 3 are the arms 31 of the shaft as well as the central tab 32 in a position folded towards the interior of the shaft as well as the side walls of the cover 33 and also the pushbuttons 34, which must classically be pressed inwards perpendicularly to the side faces to unlock the closure and release the folding tabs. Axis A-A shown in this figure shows the cutting plane of the following FIG. 4A as well as that of FIG. 4B, which consists of an enlarged view of the link 4 shown in FIG. 4A. FIGS. 4A and 4B, in which complementary references have been entered for reasons of legibility—all references relating to the link in FIG. 4B and all those relating to pieces other than the link 4 in FIG. 4A—will be described together in the following.

FIG. 4A shows that the link 4 is arranged between the attachment piece 2 and the end 11 of the strand 1, over which different holes 116 and different pre-cuts of the strand 1 are arranged, on adjustment of its length. Cutting is performed at these pre-cuts 115 to ensure that the part of the end of the strand 11 located above the hole, into which the connector bar 22 (visible in FIG. 2) will be inserted, is not too long and leaves sufficient space for insertion of the link 4 between the cut edge 111 of the end of the strand and the attachment piece 2, or more precisely the core 41 of the link 4 with thickness A. FIG. 4B shows a first inside surface of the upper wing 4321, a first inside surface of the lower wing 4221 and a first side wall on the left of the core 411 of the link 4. The space left inside these surfaces forms a first receptacle for the end of the strand 11, of which the upper surface 113 comes into contact with the first inside surface of the upper wing 4321, the lower surface 112 comes into contact with the first inside surface of the lower wing 4221 in assembled position and the cut edge 111 of the end 11 of the strand preferably comes into abutment against the left side wall of the core 411. Similarly, at the level of the right part of the link a second inside surface of the upper wing 4322, a second inside surface of the lower wing 4222 and the right side wall 412 of the core 41 of the link 4 leave a space forming a second receptacle for the central part 23 of the attachment piece 2. During attachment of the link 4 onto the attachment piece 2 the right side wall 412 of the core is preferably moved until it rests against the side surface 232 of the central part 23 of the attachment piece 2 to assure the best possible hold of the link 4 preventing any degree of freedom of translation movement to occur.

As can be seen in FIG. 4A, and as is also visible in the previously described FIG. 3, the upper wing 43 of the link 4 completely covers the end of the strand 11 of the watch band and also the central part of the attachment piece 23 respectively with its left and right parts. The lower wing 42 of the link 4 is itself in contact with the skin of the user and the gripping of the end of the strand 11 by the left parts respectively of the lower 42 and upper 43 wings prevents the cut edge 111 of the end of the stand 11 from ever being brought into contact therewith. Consequently, the comfort of the user is improved because only a level surface, and not a ridge, will ever be in contact with the skin of the user even where the closure attaches to the end of the strand of the watch band. The proposed arrangement of the intermediate link 4 between the end 11 of the strand 1 of the wrist band and the attachment piece 2 thus enables the same advantages as those previously provided by a modified attachment piece, i.e. concealment of the end of the strand 1 and prevention of any contact of the cut edge of the strand with the skin of the user, without having to modify any of the pieces forming a traditional deployment clasp watch band closure unit from now on. The attachment axis to the closure 21, the connecting pin 37 of the closure 3 to the central tab 32 that are evident from FIG. 2 and the cover 30 visible in FIG. 3 are shown on the right of FIG. 4A.

Because the intermediate link 4 prevents any contact of the cut edge 111 of the end of the strand 11 with the skin of the user, this link is sometimes described as an "anti-rotation link", as it significantly restricts the rotation of this end around its rotation axis, i.e. the connector bar 22 visible in FIG. 2. In fact, all rotation in one direction or the other is prevented by the left parts of the upper wing 43 and the lower wing 42. As can be seen in FIG. 4B, the link 4 preferably comprises an upper wing 43 with a length L equal to the sum of the length of its left part L1, the length of its right part L2 and the thickness of the core A, and a lower wing 42 with a length I that is likewise equal to the sum of the length of its left part I1, the length of its right part I2 and the thickness of the core A, with different lengths, respectively referenced L and I, for the upper wing 43 and the lower wing 42. According to the preferred variant illustrated in FIGS. 4A and 4B the length of the lower wing I is shorter than the length of the upper wing L, which maximises the covering of the end of the strand while also minimising the space below the strand. More precisely, it is the lengths of the left parts of each of the wings that are different, the length of the left part of the lower wing I1 being shorter than the length of the left part of the upper wing L1. Such an arrangement at the same time controls the rotation of the end of the strand 11, which is otherwise very limited because it is gripped by the left parts of the upper 43 and lower 42 wings, in the direction of winding the strand around the wrist of the user around the connector bar 22, which further increases the wearing comfort, since no particular force needs to be applied to close the watch band around the watch band [sic]. Moreover, this asymmetry of the lengths (I1, L1) allows easy determination of the positioning of the upper wing 43 above the lower wing 42 during assembly of the watch band to the closure and prevent any confusion.

The lengths of the right parts of the lower I2 and upper L2 wings can also be different with the same advantages of asymmetry discussed above, but with a smaller difference in length as in the illustrated preferred embodiment, and can even have identical lengths when it is not necessary to control the rotation of the attachment piece 2 in relation to the closure in the direction of winding around the wrist. The upper 231 and lower 233 surfaces of the central part 23 of the attachment piece 2 serve as guide surface respectively for the second inside surface of the upper wing 4322 of the link 4 and the second inside surface of the lower wing 422 of the link when fitting the link 4 on the central part 23 of the attachment piece 2. Similarly, the first inside surface of the upper wing 4321 and the first inside surface of the lower wing 4221 of the link 4 serve as guide surface respectively for the upper surface of the end of the strand 112 and the lower surface of the end of the strand 113, except that this time it is the end of the strand 11 that is fitted into the left part of the link 4 while the right part of the link is fitted onto the central part 23 of the attachment piece 2. Consequently, this arrangement allows a very simple fitting and assembly of the link 4 with the attachment piece 2 first of all and then with the end 11 of the strand 1.

In the preferred embodiment illustrated in FIG. 4A, where the side walls of the core of the link 4 (the left side wall 411 and the right side wall 412) act as abutment surface respectively for the cut edge of the end of the strand of the watch band 111 and as abutment surface for the side wall of the central part 232 of the attachment piece 2, wherein the hold of the link between the end of the strand 11 and the attachment piece 2 is reinforced, since no lateral displacement of the link is possible once this is arranged between the end of the strand 11 and the attachment piece 2. To improve the hold and the ease of insertion and the hold of the link 4 in assembled position, shaped wings can be used, i.e. wings with a thickness that decreases slightly from the core 41 to the exterior of the wings. The shaped structure enables prevention of any expansion of the wings when material is inserted between them, and thus enables the gripping force and the contact of the inside surfaces of the wings with the end of the strand 1 and the central part 23 of the attachment piece 2 to be maintained in an optimum manner.

According to the preferred embodiment depicted in FIG. 4B, the left part of the upper wing 43 has a first thickness E1, the right part of the upper wing 43 has a second thickness E2, the left part of the lower wing 42 has a third thickness e1 and the right part of the lower wing 42 has a fourth thickness e2. Each of these thicknesses is substantially constant over the length of the wings or, as indicated above, preferably decreases from the core to the end of the wings. The first thickness e1 is preferably smaller than the third thickness E1, but they can be identical, just as the second thickness e2, which is preferably smaller than or equal to the fourth thickness E2. As a result of this arrangement of larger thicknesses with respect to the upper wing 43 in relation to the lower wing it can be assured that no deformation will be visible on the outside surface of the upper wing of the link 431 when the link is made from a very flexible material such as an elastomer, for example. Moreover, the sum of the first and third thicknesses e1, E1 of the left side of the wings is preferably selected to be less than the sum of the second and fourth thicknesses e2, E2 on the right side of the wings, since the gripping of the left part of the wings is intended for another piece that is thicker than the right part of the wings: the end of the strand 11 and the attachment piece 2 in this case. For each type of strand 1 with a given thickness it will be possible to adjust the first and third thicknesses e1, E1 without modifying the second and fourth thicknesses e2, E2 on the right side of the wings. It will thus be possible to produce links 4 that have variable first and third thicknesses e1, E1, but with a pair of second and fourth thicknesses e2, E2 that are always identical. The differences in thickness on either side of the core of the link 41 adds to the asymmetry of the lengths of the left parts of the wings (L1 for the upper wing and I1 for the lower wing) in such a manner that likewise no confusion is possible for the insertion direction of the link 4 with a view to its assembly. This given reliability of assembly is superfluous with respect to the asymmetry of the left (linear) and right (curved with cut-out 434) ends of the upper wing. However, it can be useful for an automated assembly or in any case as a double check system to prevent any confusion.

The link 4 according to the invention has been described in combination with a deployment clasp type closure. However, it is understood that it could be used with any other type of closure using an attachment piece 2 similar to that described above. It will also be understood that the particular shape of the link 4 more generally allows it to be intended for fitting with other types of connection pieces and not necessarily a watch band strand or a closure, wherein the functions of concealment and blocking rotation to prevent parts inserted between the wings of the link from falling out can remain identical.

What is claimed is:

1. A link for a wristwatch, comprising:

a central core connecting a lower wing and an upper wing, wherein a length of the upper wing is different from a length of the lower wing, wherein the link is made from plastic material, wherein said lower and upper wings respectively comprise first and second parts, and wherein lengths of the respective first parts are different.

2. The link according to claim 1, wherein the first part of the upper wing has a first thickness, the second part of the upper wing has a second thickness, the first part of the lower wing has a third thickness, the second part of the lower wing has a fourth thickness, and wherein a sum of the first and third thicknesses is less than a sum of the second and fourth thicknesses.

3. The link according to claim 2, wherein said lower and upper wings are shaped.

4. The link according to one of the preceding claims, wherein the core comprises first flanks, the lower wing comprises second flanks and the upper wing comprises third flanks, and wherein said first, second and third flanks are located in a same plane.

5. The device for fastening a closure to a watch band strand comprising an attachment piece and a link comprising a central core connecting a lower wing and a upper wing, wherein said link is arranged between said attachment piece and an end of said strand, wherein a first inside surface of the upper wing, a first inside surface of the lower wing and a first side wall of said core of said link form a first receptacle for the end of the strand, that a second inside surface of the upper wing, a second inside surface of the lower wing and a second side wall of said core of said link form a second receptacle for a central part of said attachment piece, and wherein said upper wing covers said end of the strand and said central part of said attachment piece.

6. The device for fastening a closure to a watch band strand according to claim 5, wherein said first inside surface of the upper wing and first inside surface of the lower wing of said link act as a guide surface respectively for an upper surface of the end of the strand and a lower surface of the end of the strand.

7. The device for fastening a closure to a watch band strand according to claim 6, wherein the first and second side walls of the core of the link act respectively as an abutment surface for a cut edge of the end of the strand of the watch band and as an abutment surface for the side wall of the central part of the attachment piece.

8. The device for fastening a closure to a watch band strand according to claim 7, wherein the core of said link has first flanks and said attachment piece has side faces having inside surfaces, wherein said inside surfaces of said side faces act as guide surfaces for said first flanks of said core.

9. The device for fastening a closure to a watch band strand according to claim 8, wherein said closure comprises a protruding part and that said upper wing of said link has a cut-out, the shape of which corresponds to a shape of said protruding part of a cover of the closure.

* * * * *